US007438672B1

(12) United States Patent
Rylander et al.

(10) Patent No.: US 7,438,672 B1
(45) Date of Patent: Oct. 21, 2008

(54) DYNAMIC SYSTEM FOR A STATIONARY BICYCLE

(76) Inventors: Stephen W. Rylander, 4109 Sanger Ave., Waco, TX (US) 76710; Nicholas M. Rylander, 3722 E. 103rd St., Tulsa, OK (US) 74137

( * ) Notice: Subject to any disclaimer, the term of this patent is extended or adjusted under 35 U.S.C. 154(b) by 63 days.

(21) Appl. No.: 11/482,847

(22) Filed: Jul. 7, 2006

(51) Int. Cl.
*A63B 69/16* (2006.01)

(52) U.S. Cl. ..... 482/61; 446/396

(58) Field of Classification Search ..... 482/51, 482/57, 61, 121–123, 127, 142, 34, 79, 80, 482/145, 146, 148; D21/663, 664; 434/61, 434/67; 446/396
See application file for complete search history.

(56) References Cited

U.S. PATENT DOCUMENTS 3,762,703 A 10/1973 Gibbs
4,925,183 A 5/1990 Kim
4,958,832 A 9/1990 Kim
5,492,516 A 2/1996 Trotter
5,533,899 A * 7/1996 Young ..... 434/61
5,662,559 A 9/1997 Vasquez
5,685,806 A 11/1997 Yu
5,851,166 A * 12/1998 Bernardson ..... 482/79
5,868,654 A * 2/1999 Norian ..... 482/140
6,056,672 A 5/2000 Carbonell Tendero
6,126,577 A * 10/2000 Chang ..... 482/57
6,322,480 B1 * 11/2001 Lim et al. ..... 482/57
6,422,975 B1 * 7/2002 Chermak ..... 482/46
6,648,802 B2 * 11/2003 Ware ..... 482/57
7,081,070 B1 * 7/2006 Washington et al. ..... 482/57
2004/0053751 A1 3/2004 Pizolato

* cited by examiner

*Primary Examiner*—LoAn H. Thanh
*Assistant Examiner*—Tam Nguyen
(74) *Attorney, Agent, or Firm*—Gable Gotwals

(57) ABSTRACT

A dynamic system for making use of an exercise bicycle supported on front and rear struts, the system permitting the bicycle to sway side to side when ridden vigorously, the system including a first and a second housing for resting on a support surface, a platform retained by each housing, the platform of the first housing serving to receive thereon the bicycle front strut and the platform of the second housing serving to receive thereon the bicycle rear strut, each platform being pivotal end to end and at least one deflectable resilient member engaging each platform and functioning to normally retain the exercise bicycle uprightly.

6 Claims, 12 Drawing Sheets

DYNAMIC SYSTEM FOR A STATIONARY BICYCLE

REFERENCE TO PENDING APPLICATIONS

This application is not based upon any pending domestic or international patent applications.

FIELD OF THE INVENTION

This invention relates to dynamic bases for supporting the front and rear struts of an exercise bicycle that permit the exercise bicycle to sway from side to side when ridden vigorously to thereby replicate the feel of a regular bicycle when vigorously ridden on the open road.

BACKGROUND OF THE INVENTION

Stationary exercise bicycles have been available for many years and offer a good alternative to bicycling outdoors. The standard stationary bicycle is arranged to support a bicycle in an upright position and typically includes front and rear end struts. The struts are configured to engage a support surface such as a floor, deck or concrete surface. Most stationary bicycles include a wheel, which may be in front of or behind the rider, that spins as the rider pedals. Further, most bicycles have facilities for varying the intensity of resistance applied to the wheel so that the amount of energy required to pedal the bicycle can be varied.

Most riders of a bicycle outdoors experience varying terrain including uphill and downhill situations. For this reason nearly all bicycle riders tend to stand with their weight supported on the pedals at least part of the time. Cyclists rise out of the saddle for several reasons including to stretch their legs, relieve discomfort of the buttocks, to change the emphasis on muscles and, most importantly, to provide power for acceleration or for hill climbing. When a cyclists stands on their feet, he or she can shift the body weight from one side to the other to apply greater force to rotation of the pedals.

It is estimated by some that professional bicycle riders may ride out of the saddle in the standing position, as much as 30 to 40% of the time over the course of a race. While most recreational bicyclists do not ride out of the saddle this much, nevertheless nearly all bicycle riders spend at least part of the time in the standing position. When in the standing position, a bicyclists tends to sway the bicycle back and forth as he or she pedals so that as force is applied by one leg to push the pedal downwardly the leg is extending substantially straight with the biker's weight over the straight leg and as the biker's weight is shifted as force is applied by the other leg. By swaying the bicycle back and forth less stress is placed on the bikers skeletal components and the muscles operate more effectively and efficiently. Most exercise or stationary bicycles in use today do not provide for replicating the swaying action that is encountered in riding a bicycle in the normal way. This lack of a swaying action that is characteristic of the typical stationary bicycle imposes additional stress on the legs of the user and does not afford opportunity for varying the combination of muscles employed while riding a bicycle in the normal way.

For these reasons, the invention herein provides a dynamic system for a stationary bicycle that permits the bicycle to sway from side to side when ridden vigorously by a rider while at the same time supporting the bicycle in the usual upright position when ridden less vigorously.

For background information relating to exercise type of bicycles, reference may be had to the following previously issued United States patents.

| U.S. Pat. No. | Inventor | Title |
|---|---|---|
| US 2004/0053751 | Pizolato | Bicycle Trainer Allowing Lateral Rocking Motion |
| 3,762,703 | Gibbs | Exercising Apparatus |
| 4,925,183 | Kim | Indoor-Rollbike Apparatus |
| 4,958,832 | Kim | Stationary Exercising Bicycle Apparatus |
| 5,492,516 | Trotter | Exercise Apparatus For Use With Bicycles |
| 5,662,559 | Vasquez | Bicycle Side-Suspension System |
| 5,685,806 | Yu | Magnetic Damping Device Of An Exercise Apparatus |
| 6,056,672 | Carbonell Tendero | Training Apparatus For Cyclist and For Physical Exercise |
| 6,126,577 | Chang | Exercise Stationary Bicycle |
| 6,322,480 | Lim et al. | Indoor Bicycles For Physical Exercise |

BRIEF SUMMARY OF THE INVENTION

The invention herein relates to improvements in stationary exercise bicycles. While there are a large number of exercise bicycles in existence today, they universally are built to include front and rear support struts that rest on a support surface, such as the floor of a building, or a garage or patio surface. Thus the standard exercise bicycle remains rigidly upward regardless of how vigorously it is ridden by the user. This invention provides an inexpensive and easy to use way of improving the exercise experience of a typical user.

The dynamic system of this invention is adapted for use with an exercise bicycle having front and rear support struts. The system permits the bicycle to sway side to side when ridden vigorously.

The dynamic system of this invention consists of a first and second housing for resting on the support surface. A platform is retained by each housing. The platform of the first housing serves to receive thereon an exercise bicycle front strut and the platform of the second housing serves to receive thereon the exercise bicycle rear strut. Each platform is pivotal end to end.

At least one deflectable resilient member engages each platform and functions to normally retain the exercise bicycle uprightly. However, each platform tilts in response to action applied by a rider to the bicycle as the bicycle is ridden vigorously.

In this way, the rider experiences the normal attitude of a bicycle when ridden vigorously as well as when ridden leisurely.

A better understanding of the invention will be obtained from the following detailed description of the preferred embodiments and the claims taken in conjunction with the drawings.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENTS

It is to be understood that the invention that is now to be described is not limited in its application to the details of the construction and arrangement of the parts illustrated in the accompanying drawings. The invention is capable of other embodiments and of being practiced or carried out in a variety of ways. The phraseology and terminology employed herein are for purposes of description and not limitation.

Elements shown by the drawings are identified by the following numbers:

| | |
|---|---|
| 10 | Biker riding a bicycle |
| 12R | Right leg |
| 12L | Left leg |
| 14 | Downward force |
| 16R | Right pedal |
| 16L | Left pedal |
| 17 | Bicycle tire |
| 18 | Bicycle |
| 19 | Road |
| 20 | Biker |
| 22 | Vertical centerline |
| 24 | Biker's ankle |
| 26 | Biker's knee |
| 28 | Biker's quadricep muscle |
| 30 | Biker's hip joint |
| 38 | Exercise bicycle |
| 40 | Components |
| 42 | Straps |
| 44 | Platform |
| 46 | Assemblies |
| 48 | Front bicycle cross member |
| 50 | Rear bicycle cross member |
| 52A | Collar |
| 52B | Collar |
| 54 | Underneath side |
| 56 | Tension spring |
| 56A | Spring coils |

-continued

| | |
|---|---|
| 56B | Spring center portion |
| 56C | Spring arms |
| 58 | Tension spring |
| 58A | Spring coil |
| 58B | Spring center portion |
| 58C | Spring arms |
| 60 | Tubular rod |
| 62 | Housing |
| 64A | Bearing pad |
| 64B | Bearing pad |
| 66 | Radiused groove |
| 68R | Resilient member |
| 68L | Resilient member |
| 70A | Post |
| 70B | Post |
| 72A | Extendable coiled spring |
| 72B | Extendable coiled spring |
| 74A | Compressed coiled spring |
| 74B | Compressed coiled spring |
| 76A | External spring guide |
| 76B | External spring guide |
| 78A | Internal spring guide |
| 78B | Internal spring guide |
| 80 | Large diameter coiled spring |
| 82 | Cylindrical disc |
| 84 | Housing bottom |
| 88 | Base |
| 90A | Conical volute spring |
| 90B | Conical volute spring |
| 92A | Pin |
| 92B | Pin |
| 93A | Cup |
| 93B | Cup |
| 94 | Strap clip |
| 96A | Housing sidewalls |
| 96B | Housing sidewalls |
| 98A | Housing end wall |
| 98B | Housing end wall |
| 100 | Pins |
| 102 | openings |
| 104 | Pillow block |
| 106A | First bellows |
| 106B | Second bellows |
| 108A | First tube |
| 108B | Second tube |
| 110 | Valve |

Figure 2:
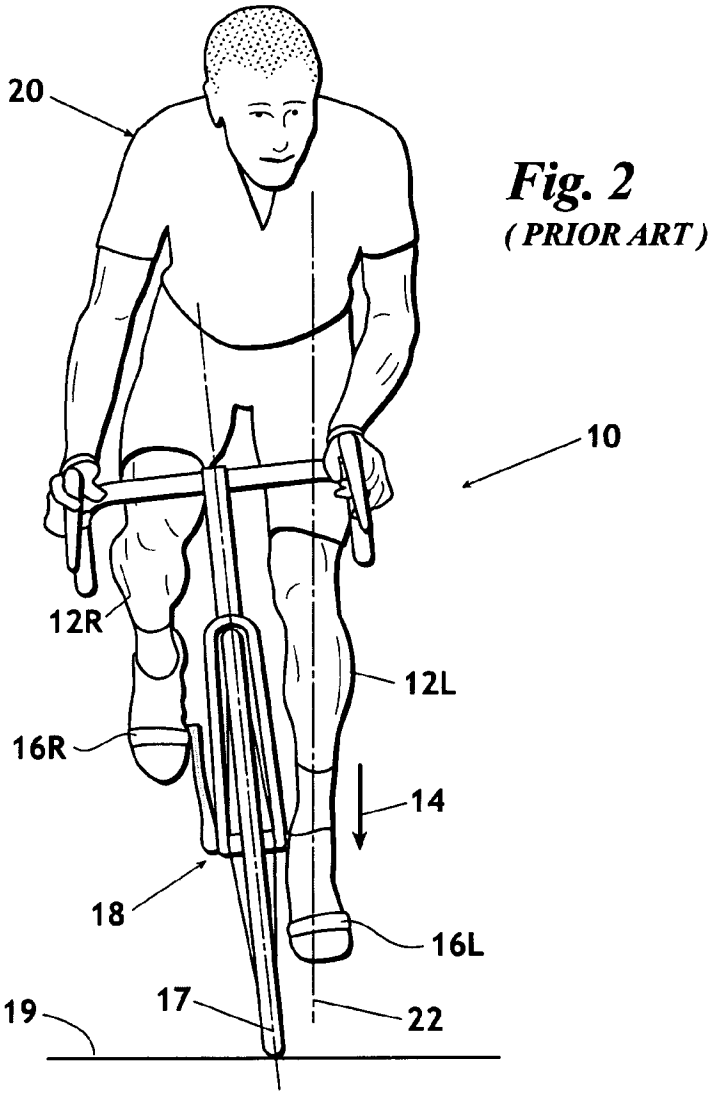
Fig. 2 ( PRIOR ART )
FIG. 2 is a front elevational view of a biker on a touring bicycle on the open road, his left leg extended.
Figure 1:
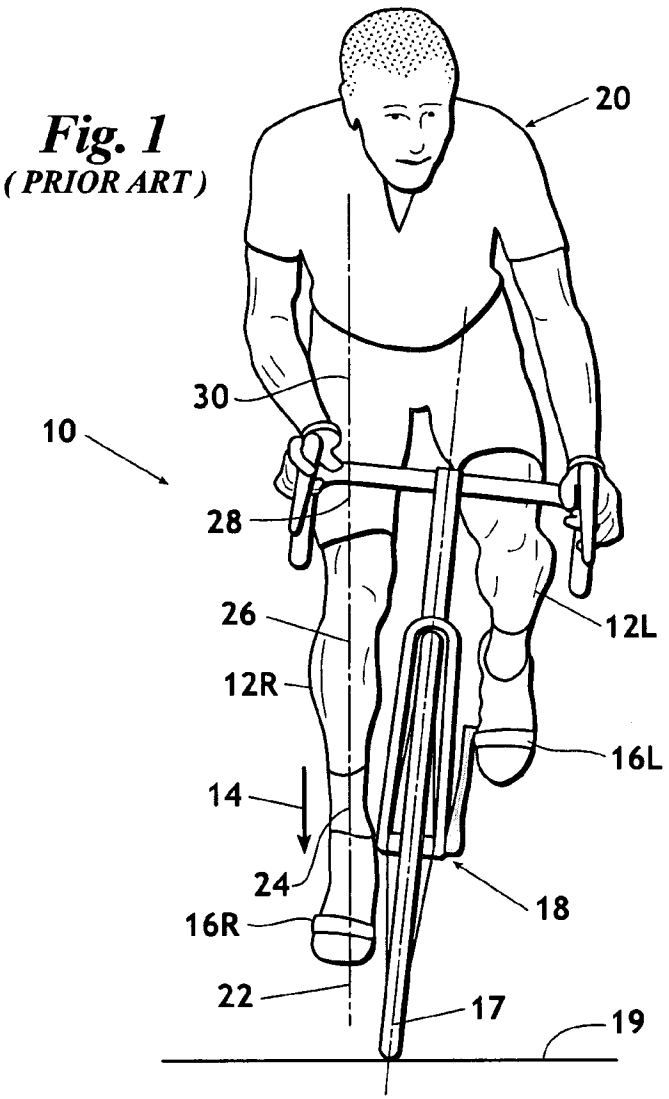
Fig. 1 ( PRIOR ART )
FIG. 1 is a front elevational view of a biker on a touring bicycle on the open road, his right leg extended.

FIGS. 1 and 2 are each front elevational views of a biker 20 on a bicycle 18 as ridden on the open road, illustrating the swaying motion common to this endeavor, particularly during times when biker 20 is "standing up" on pedals 16L and 16R for increased exertion. FIG. 1 shows the biker's right leg 12R extended, applying downward force 14 to pedal 16R. The lean of bicycle 18 is typically about 6° to the left of biker 20. This allows the right leg 12R to push downward in a vertical plane, the edge of which is indicated by a vertical centerline 22. Note that the pedal 16R and the biker's ankle 24, knee 26, quadricep muscle 28, hamstring muscle set (not visible) and hip joint 30 are within this vertical plane, thus providing optimum leverage during the downward push of right leg 12R. During straight-ahead travel the center of gravity of the system 10 (that is, the biker 20 plus bicycle 18) lies generally directly above the contact point between the bicycle tire 17 and the road 19. An exception to this, of course, would be when biker 20 was negotiating a turn.

FIG. 2, conversely, illustrates the geometry when the biker's left leg 12L is extended, applying downward force 14 on pedal 16L. The above description of FIG. 1 may be applied to FIG. 2 in a mirror-opposite fashion.

FIGS. 1 and 2 show, as background information, how a bicycle typically sways side to side when ridden vigorously by a biker. The invention herein, to now be described, provides a system, method and apparatus by which a typical stationary exercise bicycle can readily and inexpensively be adapted to replicate the normal feel of a bicycle when ridden vigorously.

Figure 3:
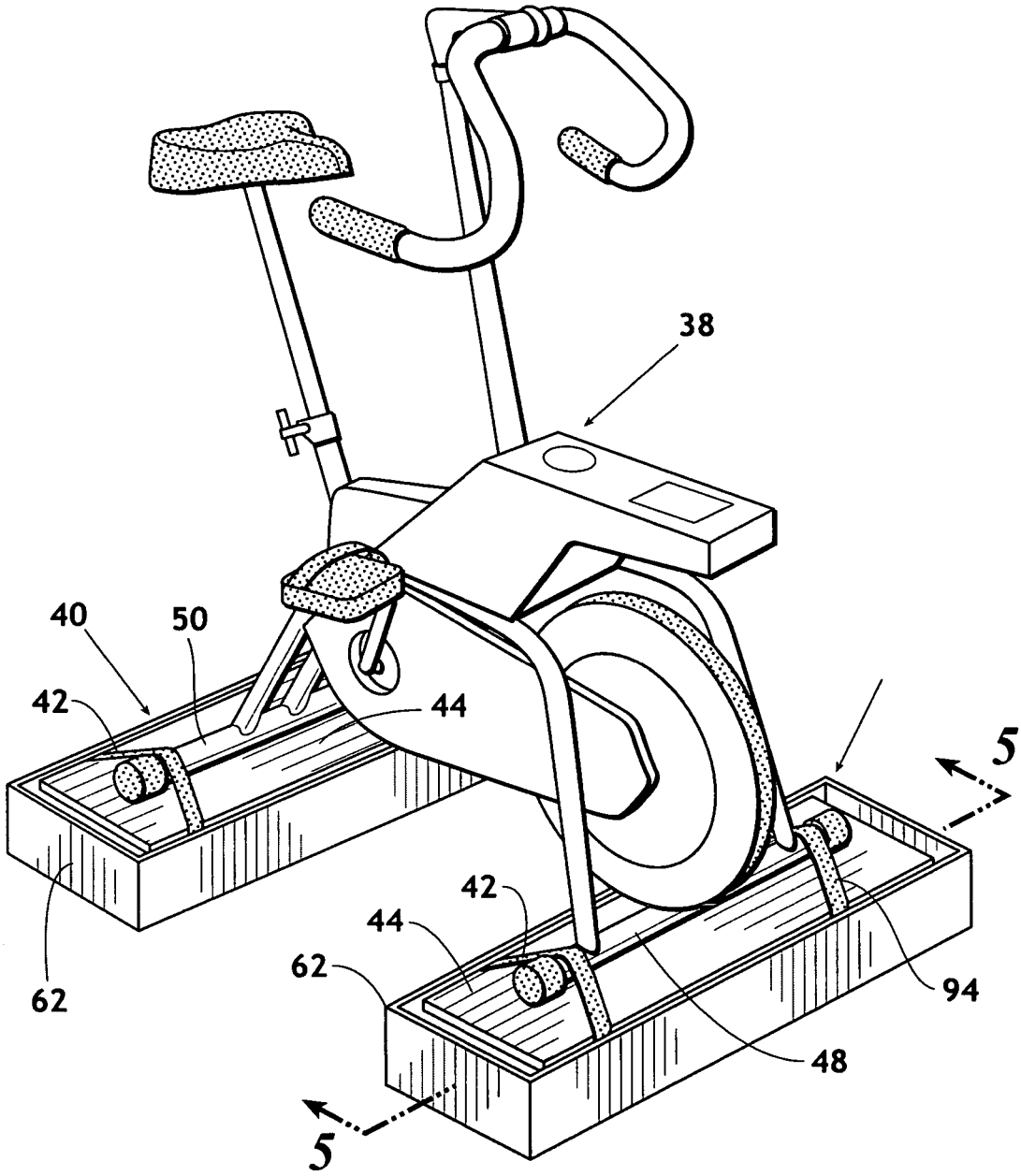
FIG. 3 is a perspective view illustrating a typical exercise bicycle secured atop a pair of dynamic bases of the current invention.

FIG. 3 is a perspective view illustrating an embodiment of the invention whereby an existing stationary exercise bicycle 38 is secured atop two identical components 40 which, working in concert, allow stationary bicycle 38 to oscillate left and right with the body motion of a rider, not shown, thereby emulating the swaying experienced with a touring bicycle on the open road as illustrated in FIGS. 1 and 2. Straps 42 are shown as a method of securement of stationary bicycle cross-members 48 and 50, but any well-known securing device, such as clamps or brackets, would suffice. Stops, not shown, can be provided to prevent bicycle 38 from sliding on the individual platforms 44. A simple exercise bicycle 38 is illustrated, but it may be one of any degree of technology or design.

The invention herein is in components 40, a pair of which can be used to quickly adapt a typical stationary exercise bicycle so that a user thereof experiences the natural oscillations of a normal bicycle being ridden vigorously on the open road.

FIGS. 4, 5, 6 and 7 depict a first embodiment of the current invention wherein the left-to-right oscillating motion is accomplished by means of two identical assemblies 46, one under the lower front cross-member 48 and one under the lower rear cross member 50 of bicycle 38 as seen in FIG. 3.

Figure 4:
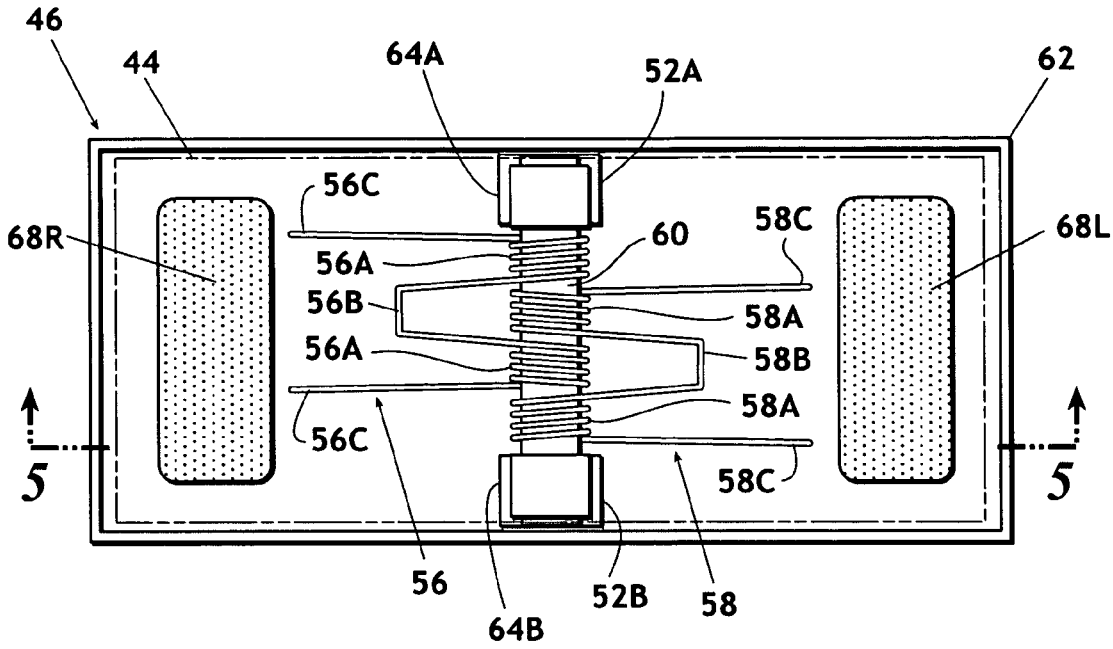
FIG. 4 is a top plan view of a first embodiment of the current invention.

Each of the two assemblies 46 of this embodiment comprises a rectangular platform 44 having two integral axially-aligned collars 52A and 52B affixed to the underneath side 54. Two identical tension springs 56 and 58, best seen in FIG. 4, are nested in opposing orientation and placed so that spring coils 56A and 58A align with the inside diameters of tubular collars 52A and 52B. Tubular rod 60 is inserted through collar 52A, spring coils 56A and 58A, and collar 52B, thereby securing springs 56 and 58 in place. Means (not shown) to secure rod 60 within collars 52A and 52B can include cotter pins, retaining rings, or simply a press fit, considering that rod 60 need not rotate.

Once springs 56 and 58 are held in place by rod 60 secured in collars 52A and 52B, the platform 44 of each assembly 46 is attached to a cross-member 48 or 50 of exercise bicycle 38 by means of straps 42 (best seen in FIG. 3 but not seen in FIGS. 4, 5, 6 and 7), or any well-known method such as brackets or clamps. Tension spring 56 includes spring coils 56A, a spring center portion 56B and spring arms 56C. In like manner, tension spring 58 includes spring coils 58A, a spring center portion 58B and spring arms 58C.

The assembly 46 is contained in a housing 62. Tubular collars 52A and 52B rest in bearing pads 64A and 64B respectively (best seen in FIG. 4), each of which has a radiused groove 66 in its top surface. The radius of groove 66 is half the outside diameter of tubular collars 52A and 52B, providing an arcuate mating surface. The material of bearing pads 64A and 64B may be a plastic having a low coefficient of friction, such as Teflon® or nylon, or one of the many self-lubricating molybdenum-impregnated fiberglasses or plastics. Bearing pads 64A and 64B are attached to the floor of housing 62 in any well-know manner, such as bonding or bolting.

The weight of exercise bicycle 38 is sufficient to flex the tension springs 56A and 56B and allow collars 52A and 52B to contact bearing pads 64A and 64B respectively. Identical resilient members 68R and 68L are also flexed by the weight of exercise bicycle 38 and provide further stability and additional recuperative forces outboard of springs 56 and 58.

FIG. 4 is a top plan view of an assembly 46 of this embodiment. Platform 44 is indicated with phantom lines to better illustrate the mechanism below.

Figure 5:
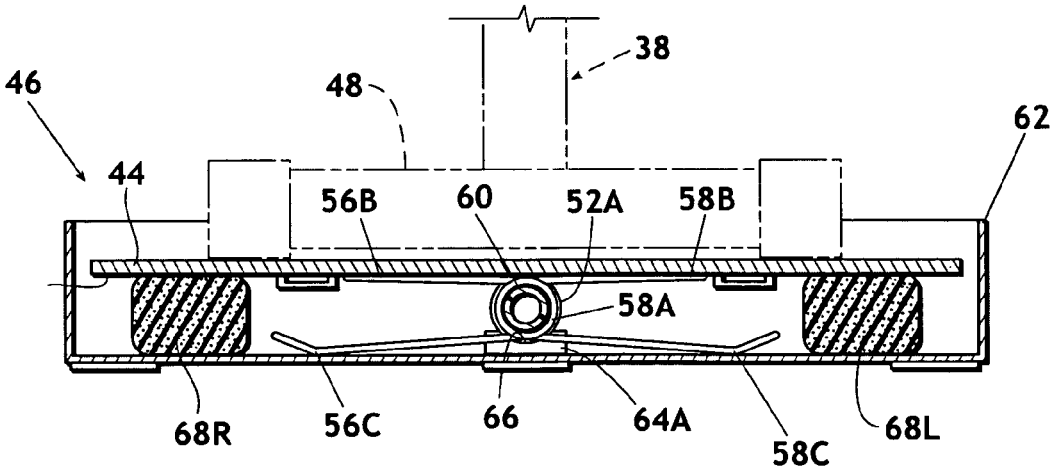
FIG. 5 is a sectional elevational view taken along cutting plane 5-5 of FIG. 4.

FIG. 5 is a front elevational cross section view taken along cutting plane 5-5 of FIG. 4. By way of orientation, a rider would be facing the viewer. FIG. 5 illustrates the "at rest" or neutral position, or the position midway through the side-to-side oscillating motion. An existing exercise bicycle 38 is partially indicated by phantom lines. Tension spring 56 has a spring center portion 56B bearing against the underneath side of platform 44 and spring arms 56C bearing against the floor of housing 62. Tension spring 58 is nested in opposing orientation from spring 56 and has a spring center 58B bearing against the underneath side of platform 44 and arms 58C bearing against the floor of housing 62. Thusly arranged, identical tension springs 56 and 58 provide equal and opposite forces to platform 44 and therefore to the exercise bicycle 38. Likewise, identical resilient members 68R and 68L, partially compressed, offer equal and opposite forces to the system. The resulting "at rest" position is one in which exercise bicycle 38 is vertical with respect to the horizontal.

Figure 6:
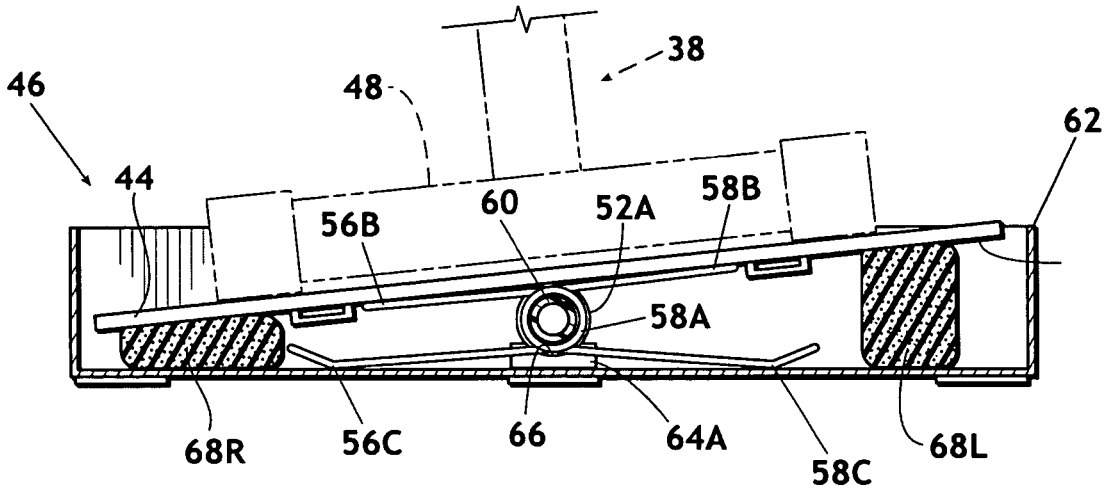
FIG. 6 is a sectional elevational view showing a different position from FIG. 5.

FIG. 6 depicts the assembly of FIG. 5 in a position caused by the downward thrust of the rider's right foot, that is, swaying to the right as would a touring or racing bike on the open road. Spring 56 is torqued tighter and spring 58 is relaxed somewhat, but still under some torque. Resilient member 68R is further compressed and resilient member 68L is relaxed somewhat, but still slightly compressed. The above described condition of spring 56 and resilient member 68L is important for the smooth and quiet operation of the exercise bicycle while in vigorous use.

Figure 7:
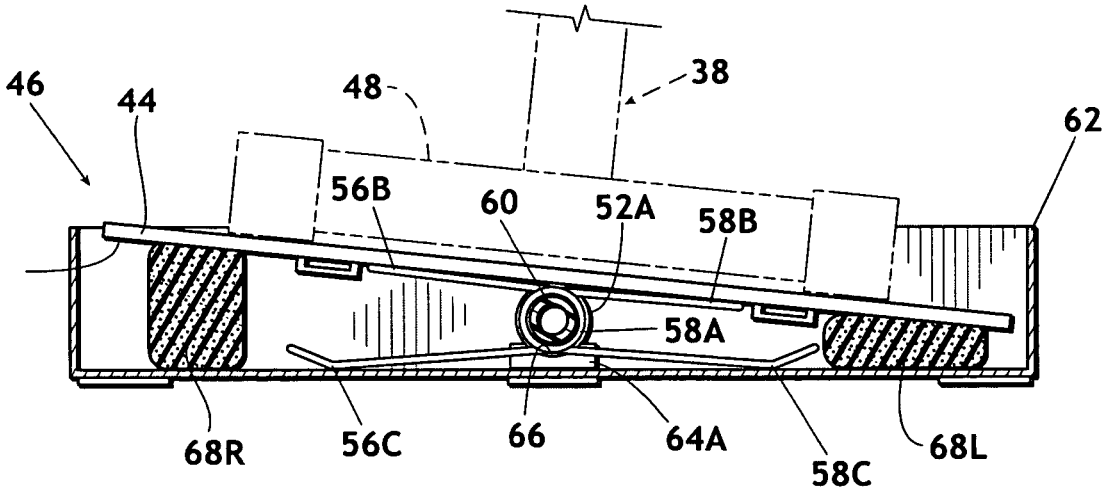
FIG. 7 is a sectional elevational view showing yet another different position from FIG. 5.

FIG. 7 depicts the alternate, or mirror-opposite position of that position shown in FIG. 6. Spring 58 is torqued tighter and resilient member 68L is further compressed as a result of the downward thrust of a rider's left foot. Spring 56 is relaxed somewhat but still under some torque, and resilient member 68R is relaxed somewhat but still slightly compressed.

As a seated rider pedals the exercise bicycle 38 the motion of platform 44 would be slight and gentle, not reaching the maximum positions shown in FIGS. 6 and 7. When the rider stands on the pedals and exercised more vigorously the oscillating motion would increase to approximately the positions shown in FIGS. 6 and 7. In both instances, seated and pedaling easy or standing and pedaling vigorously, the resulting motion would emulate that motion of a touring or racing bike on the open road, thereby providing a more natural and efficient regimen or training session.

Figure 8:
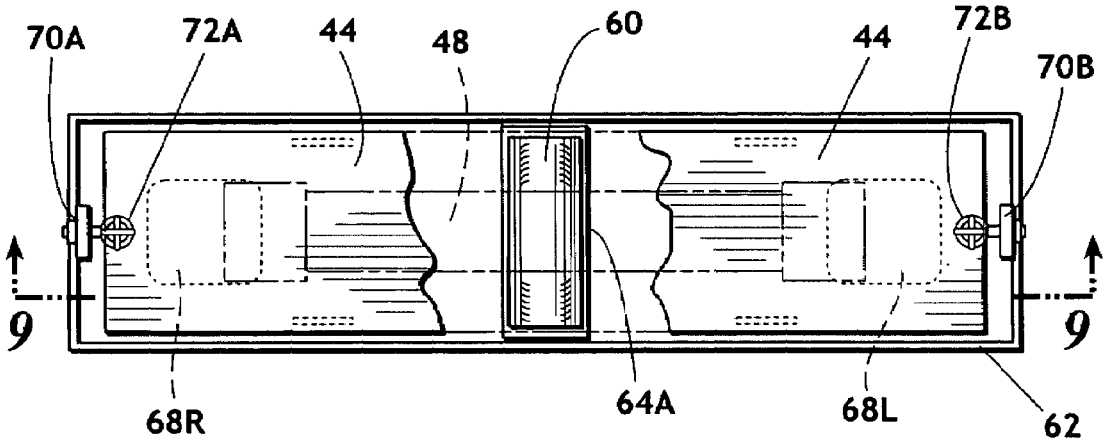
FIG. 8 is a top plan view of a second embodiment of the current invention.
Figure 9:
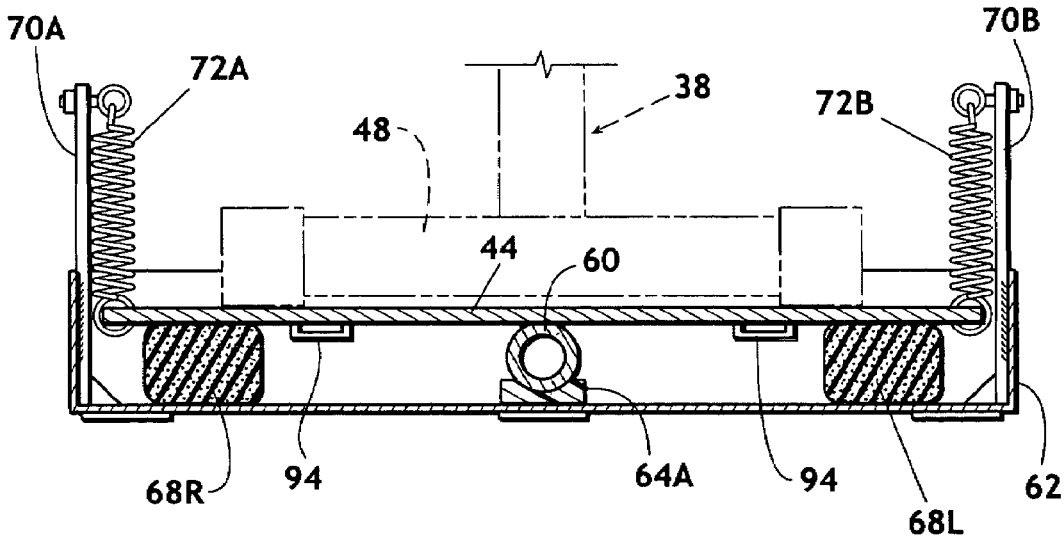
FIG. 9 is a sectional elevational view taken along cutting plane 9-9 of FIG. 8.
Figure 10:
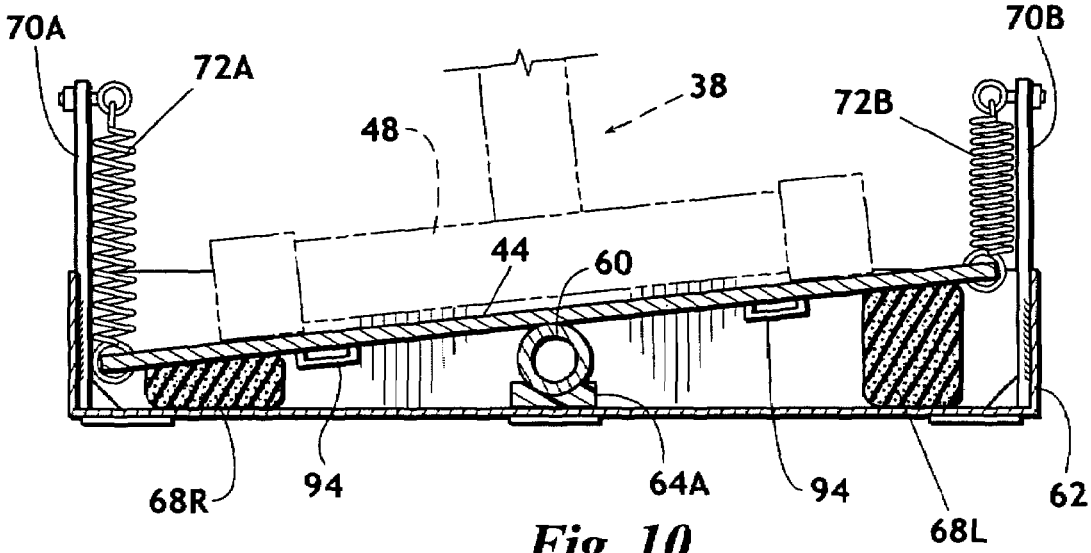
FIG. 10 is a sectional elevational view showing a different position from FIG. 9.
Figure 11:
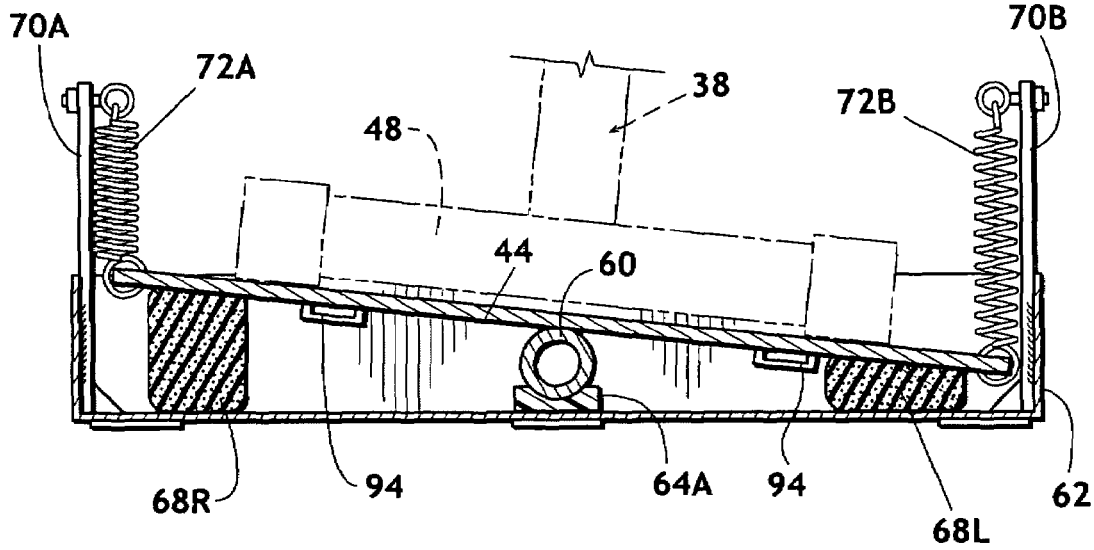
FIG. 11 is a sectional elevational view showing yet another different position from FIG. 9.

An alternate embodiment of the invention is illustrated in FIGS. 8 through 11, each of which shows a housing 62 that supports a tiltable platform 44 that receives thereon an exercise bicycle 38 as described with reference to FIGS. 3 through 7. However, the new embodiment illustrates different spring arrangements. In FIGS. 8 through 11 opposed posts 70A and 70B are secured to housing 62 beyond either end of the tiltable platform 44. Affixed to upper ends of post 70A is an extendable coiled spring 72A while suspended from an upper end of post 70B is an extendable coiled spring 72B. The lower end of each of the coiled springs 72A and 72B is attached to an outer end portion of tiltable platform 44. Platform 44 pivots about a tubular rod 60 that is rotatably supported by a bearing pad 64A having a semi-circular recess therein. Springs 72A and 72B function to keep platform 44 normally in a horizontal position or, that is, in a position horizontal to the surface on which housing 62 is positioned. FIGS. 8 and 9 show platform 44 in a normal or usual position in which it is horizontal and each of the springs 70A and 70B are subjected to the same tension. FIG. 10 shows the situation in which bicycle 38 is being pedaled vigorously so that the rider moves the bicycle to the left, shifting the center of his body to the right, and thereby stretching extendable coiled spring 72A, while reducing the extension of the opposed coiled spring 72B. FIG. 11 shows the opposite in which the rider of the bicycle 38 as shifted the bicycle to the right.

In addition, as with FIGS. 4 through 7, left and right resilient members 68R and 68L are employed to provide further resiliency of the tiltable position of platform 44.

It is to be understood, as stated with reference to FIGS. 4 through 7, that it is not imperative that both means of establishing resiliency be employed. That is, in some embodiments of the invention the use of the resilient member 68R and 68L may not be required and the entire resilient positioning of tiltable platform 44 is controlled by springs 72A and 72B or, on the contrary, springs 72A and 72B may be eliminated and only the resilient members 68R and 68L are employed to maintain platform 44 normally in a horizontal position but to permit it to pivot in response to the shifting weight of the rider of exercise bicycle 38.

Figure 12:
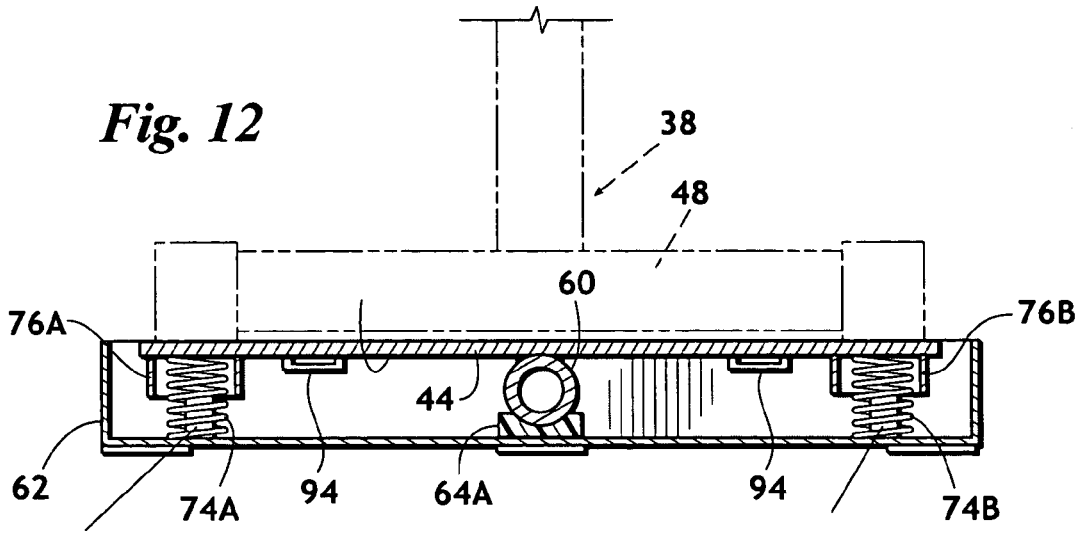
FIG. 12 is a sectional elevational view of a third embodiment of the current invention.
Figure 13:
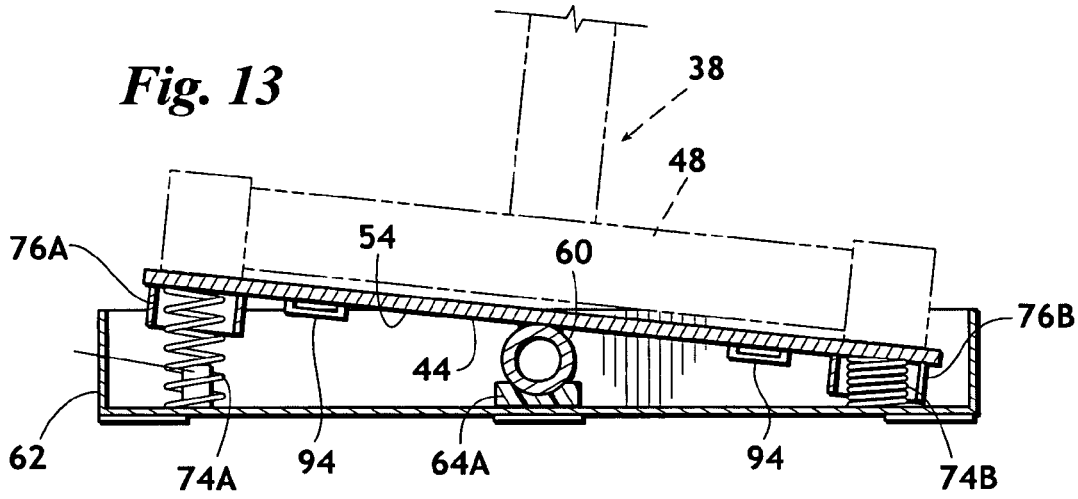
FIG. 13 is a sectional elevational view showing a different position from FIG. 12.
Figure 14:
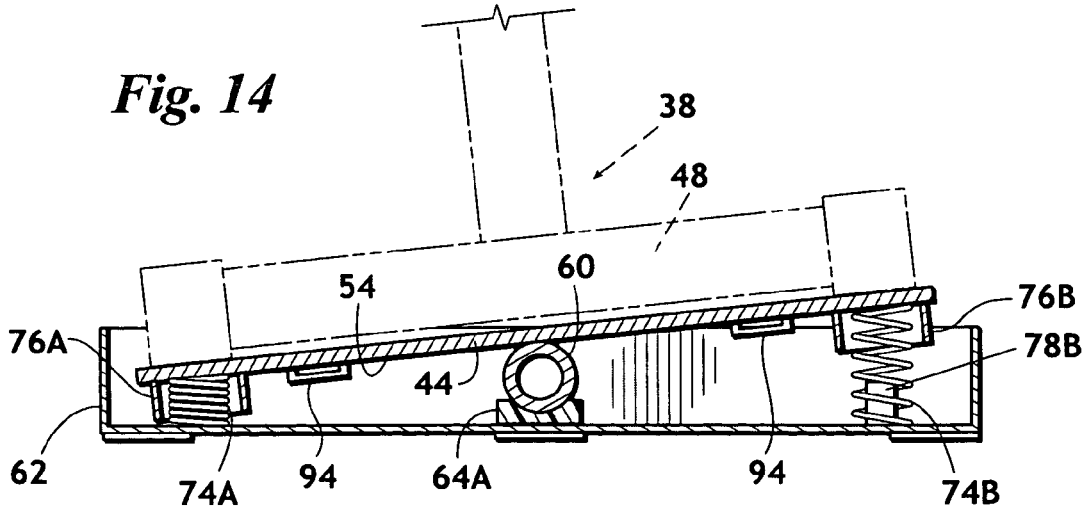
FIG. 14 is a sectional elevational view showing yet another different position from FIG. 12.

FIGS. 12, 13 and 14 show an alternate embodiment of the invention. In this embodiment housing 62, platform 44, tubular rod 60 and a bearing pad 64A are employed as in the embodiment of FIGS. 10 and 11. However, in FIGS. 12, 13 and 14 the resilient force that is provided to maintain platform 44 essentially horizontal is different. In this embodiment, compressed coiled spring 74A and 74B are utilized. Compressed coiled spring 74A and 74B are positioned within housing 62 and engage the underneath side 54 of platform 44.

External spring guides 76A and 76B are secured to the underneath side 54 of platform 44. Spring guides 76A and 76B are short length tubular members of internal diameters greater than the external diameters of springs 74A and 74B and fit about the springs to ensure that they are retained in position. Short length internal spring guides 78A and 78B are secured to the interior surface of the bottom of housing 62. These internal spring guides are in the form of short upstanding posts which may typically be cylindrical and of external diameter less than the internal diameter of springs 74A and 74B. Springs 74A and 74B remain under compressive tension at all times. That is, in FIG. 13 which shows the platform 44 tilted to the right and therefore compressed external spring 74A extended, nevertheless spring 74A is still under slight compression. The compressive force exerted by springs 74A and 74B serve to balance each other and keep the platform 44 in a substantially horizontal pattern, as seen in FIG. 12, except when a rider leans exercise bicycle 38 to his left or right.

Figure 15:
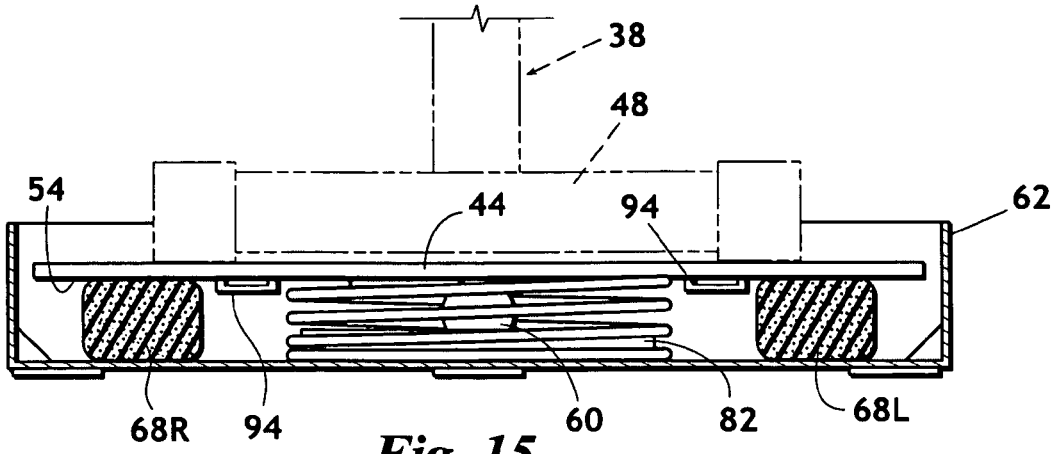
FIG. 15 is a sectional elevational view of a fourth embodiment of the current invention.
Figure 16:
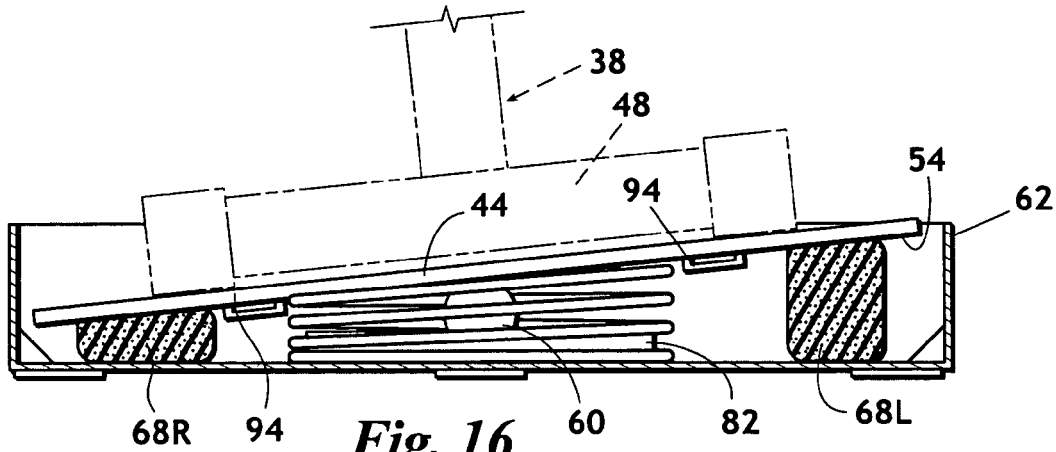
FIG. 16 is a sectional elevational view showing a different position from FIG. 15.
Figure 17:
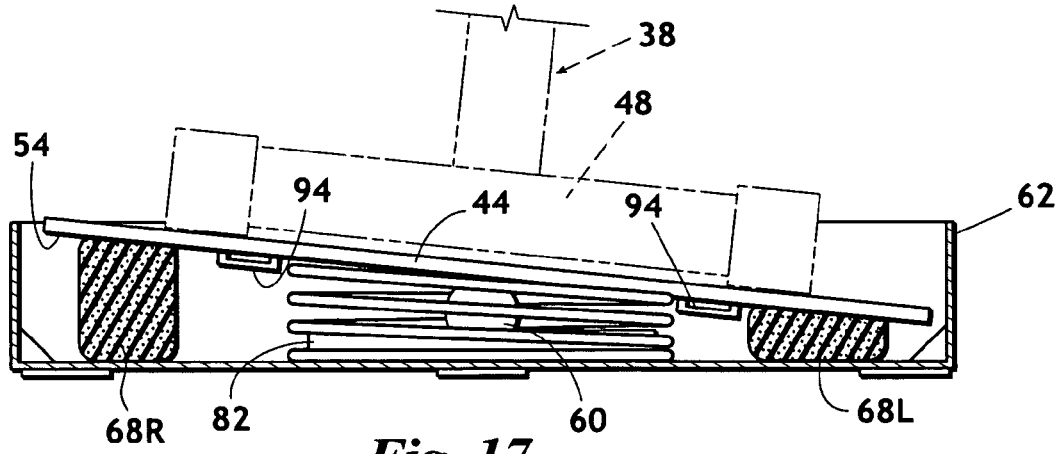
FIG. 17 is a sectional elevational view showing yet another different position from FIG. 15.

FIGS. 15 through 17 show another alternate embodiment which provides a different compressive arrangement for maintaining platform 44 normally in an essentially horizontal position except when a rider moves bicycle 38 to left or right in the process of vigorously riding. This embodiment employs a large diameter coiled spring 80 positioned centrally within housing 62 to engage the underneath side 54 of platform 44. A cylindrical disc 82 is secured to the internal surface of the bottom portion of housing 62. The cylindrical disc 82 is of external diameter less than the internal diameter of large diameter coiled spring 80 and serves to keep the large diameter coiled spring centrally positioned within housing 62 and central of platform 44.

Platform 44 pivots on a tubular rod 60 as described with the previous embodiments. The tubular rod 60 rests in a bearing pad which is not seen in FIGS. 15 through 17 but is similar and provides the same function as the bearing pad 64A in FIGS. 12 through 14. The bearing pad can be made integral with cylindrical disc 82 or can be a separate element in which the cylindrical disc 82 has recesses to accommodate the bearing pad.

Resilient members 68R and 68L are positioned within the housing 62 and below platform 44 and function to assist in providing resilient forces to normally maintain platform 44 horizontally as described with reference to FIGS. 4 through 9. Essentially, the resilient member 68R and 68L take place of the coiled compressive springs 74A and 74B in the embodiment of FIGS. 12 through 14.

Figure 18:
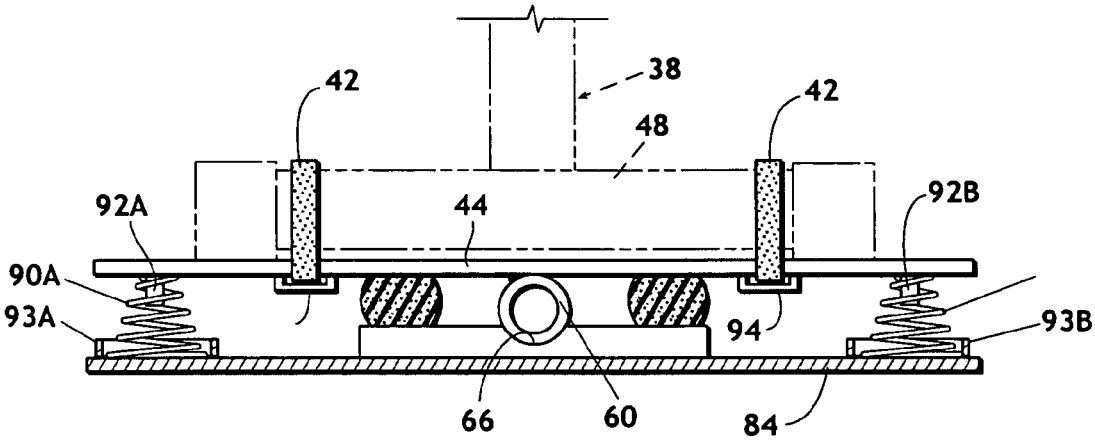
Figure 19:
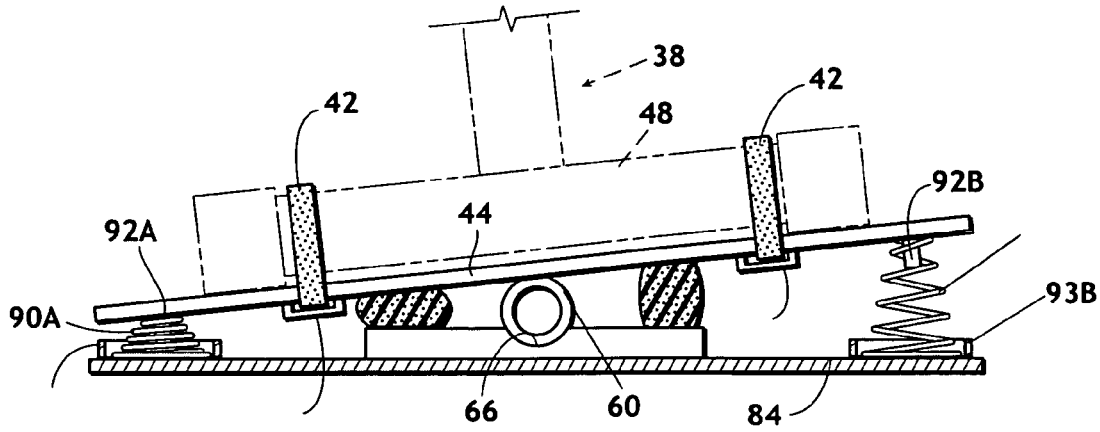

FIGS. 18 and 19 show another alternate embodiment of the invention. Whereas the previous embodiments have shown a housing that contains the dynamic system for an exercise bicycle, in FIGS. 18 and 19 only a housing bottom 84 is shown, that is, in these figures the sidewall to the housing are not illustrated. While sidewalls are not indispensable nevertheless the use of a housing with sidewalls is preferred to prevent objects from lodging under platform 44 or to prevent a bystander's hands or toes getting under the oscillating platform.

As with the previous embodiments, in FIGS. 18 and 19 platform 44 oscillates with respect to a tubular rod 60. In this embodiment, tubular rod 60 is positioned on a larger base 88 which rests on the housing bottom 84, the base 88 having a radiused groove 66 therein.

As compared with the embodiments of FIGS. 12 through 14, in FIGS. 18 and 19 resiliency is applied to platform 44 by conical volute type springs 90A and 90B that have a range in motion somewhat greater than the constant diameter of the springs shown in the embodiment of FIGS. 12 through 14.

The largest diameter or lower ends of springs 90A and 90B are received in shallow cups 93A and 93B, the cups being affixed to base 84. The upper or smaller diameter ends of conical volute springs 90A and 90B are received by pins 92A and 92B that are secured to the bottom of platform 44.

In a manner similar to the embodiments of FIGS. 5 and 9, in addition to springs that provides resiliency in the embodiment of FIGS. 18 and 19, resilient members 68R and 68L are employed. These resilient members are flexed or compressed as platform 44 tilts when a bicycle 38 supported on the platform is ridden vigorously.

Exercise bicycle 38 includes, as shown in dotted outline, a cross member 48 that forms a part of the strut which supports either the front end or rear end of the exercise bicycle. This cross member 48 is secured to platform 44 by means of straps 42 as seen in FIGS. 3, 18 and 19 and other figures. The straps are retained in position by means of strap clip 94 secured to the bottom surface of platform 44.

FIG. 18 shows the relationship of components when bicycle 38 is not being used or when being used and the rider is riding at a relaxed pace while FIG. 19 shows the bicycle as it is moved side to side when the rider is vigorously pedaling the bicycle. FIG. 19 shows the exercise bicycle 38 pivoted in one direction causing pivotation in the opposite direction being similar except that springs 90B and resilient members 68L are compressed.

FIGS. 20 through 24 show an additional alternate embodiment. Housing 62 is illustrated in more detail to show, in addition to a housing bottom 84 as previously referenced, housing sidewalls 96A and 96B and end walls 98A and 98B. Bearing pad 64A is of greater depth than in any other view and has radiused groove 66 therein. Tubular rod 60 is shown as a solid member that is provided with a flat surface secured to the bottom surface of platform 44.

Positioned within housing 62 are resilient members 68R and 68L. In this embodiment the resilient members are each formed of a stack of resilient pieces such as made of plastic foam or the like and in which the resiliency of each portion of the stack is different and showing higher density portions being on the bottom of the stack and lower density portions on the top of the stack. Pins 100 on the top of bearing pad 64A extend through openings 102 in platform 44, the pins serving to maintain platform 44 in position but allowing it to pivot on bearing block 64A.

Figure 20:
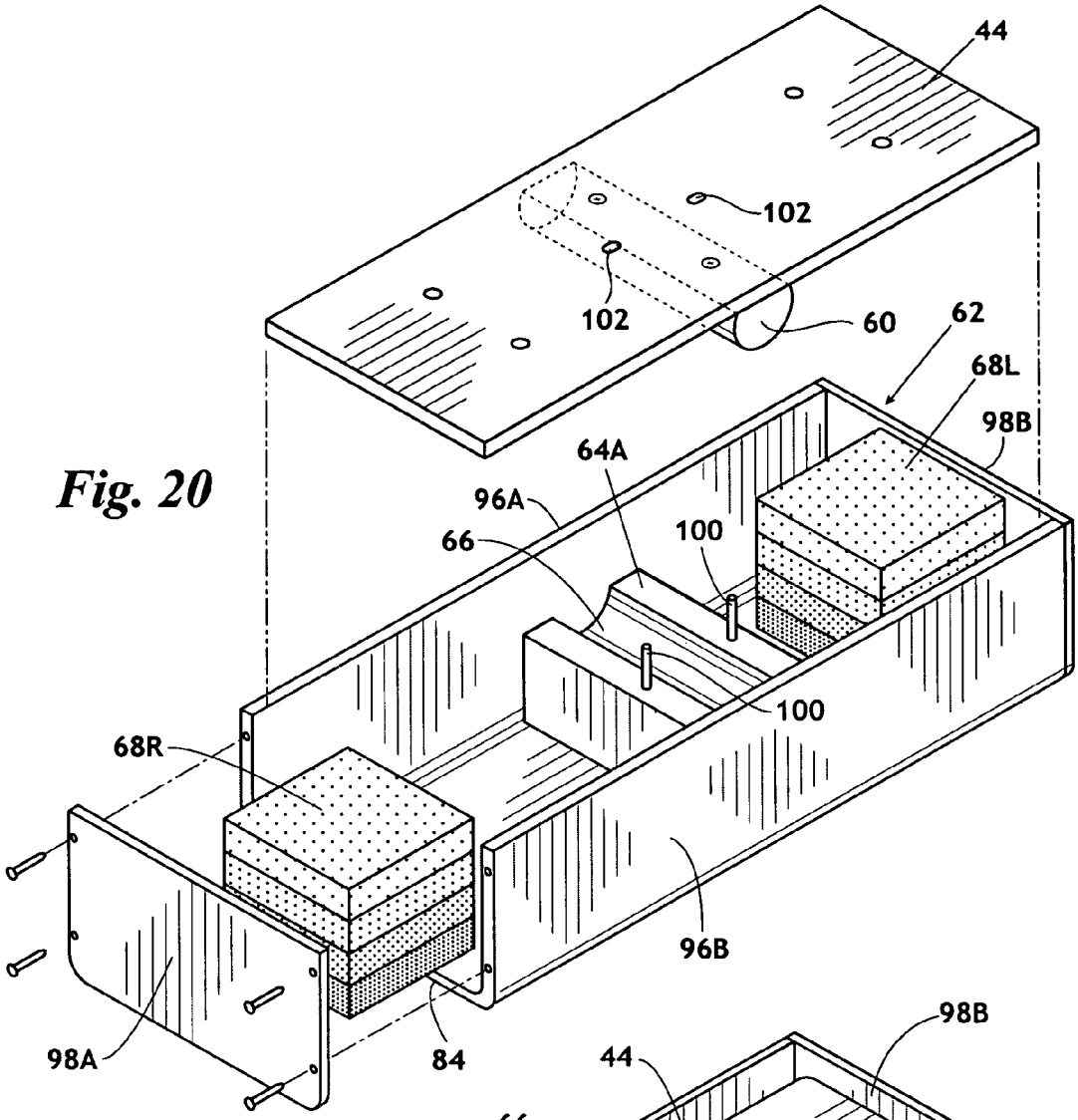
Figure 21:
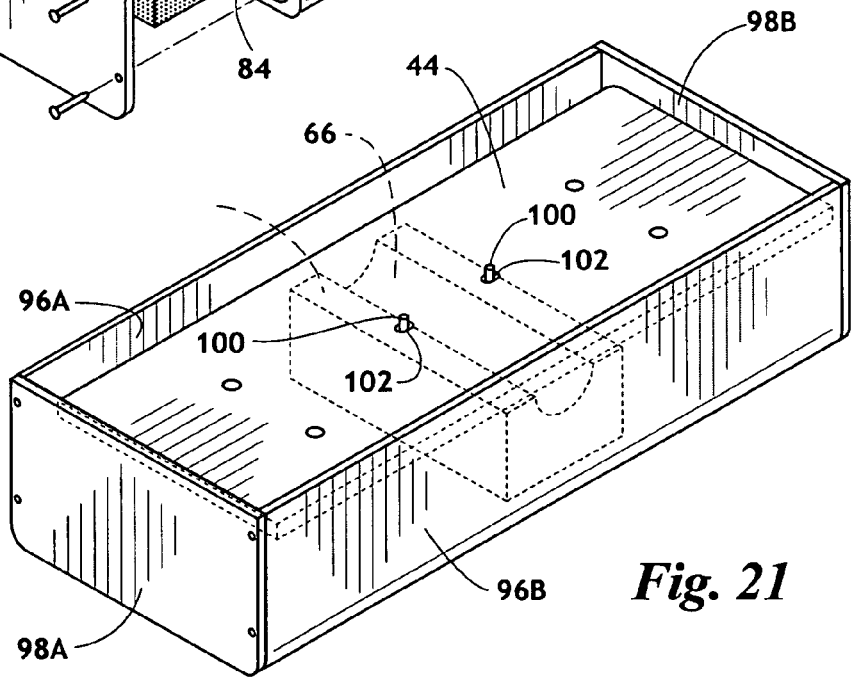
Figure 22:
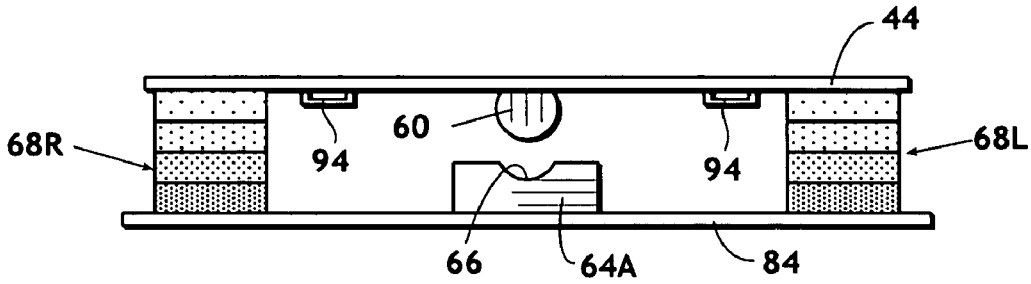
Figure 23:
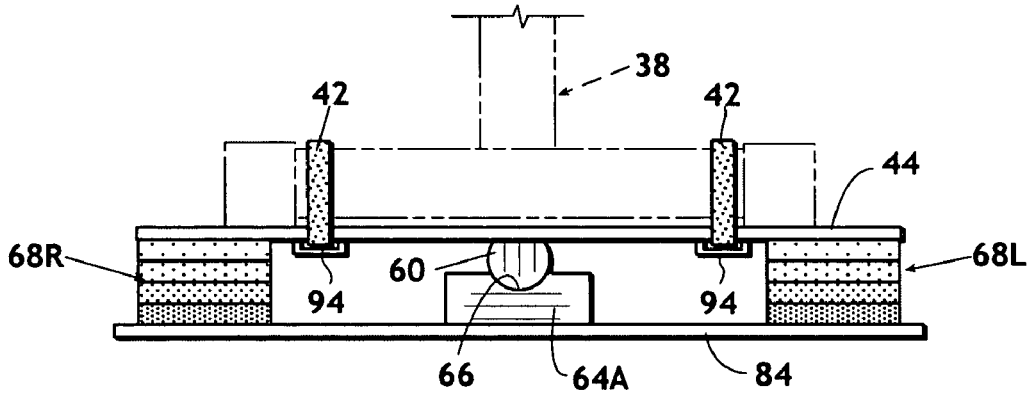
Figure 24:
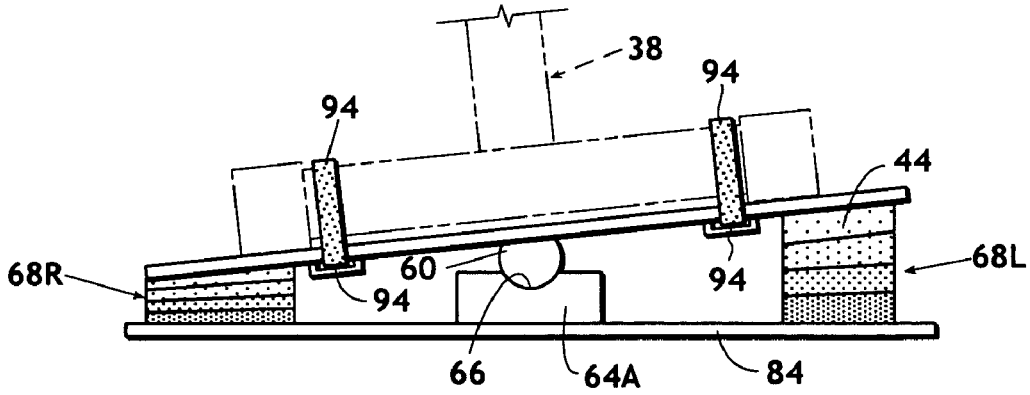

FIG. 21 shows the components of FIG. 20 assembled and ready to receive the forward or rearward strut of an exercise bicycle thereon. FIGS. 22, 23 and 24 illustrate the operation of the embodiment of FIGS. 20 and 21. In FIGS. 22 through 24 the sidewalls and end walls of housing 62 are not shown. Only housing bottom 84 is shown. FIG. 22 shows the relationship of components without any weight applied to platform 44, such as the condition if a front or rearward strut portion of a bicycle was not in place.

FIG. 23 shows the exercise bicycle 38 in place and held to platform 44 by means of straps 42. Sufficient weight is on platform 44 to cause the tubular rod 60 to rest in radiused groove 66 and the resilient members 68R and 68L are slightly compressed.

FIG. 24 shows the relationship of components when a biker is riding the exercise bicycle 38 vigorously and shows the bicycle tilted to one side.

Figure 25:
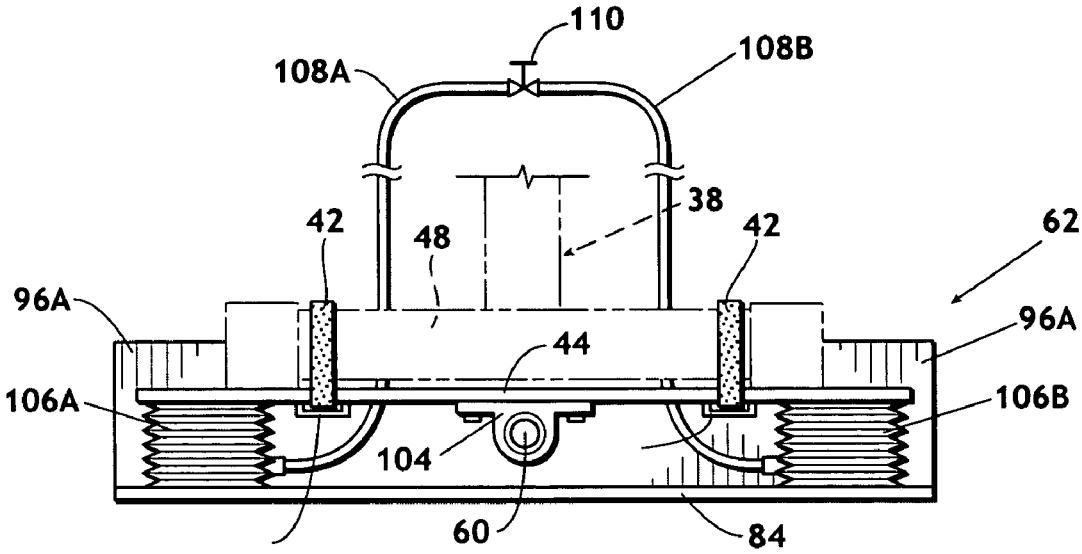
Figure 26:
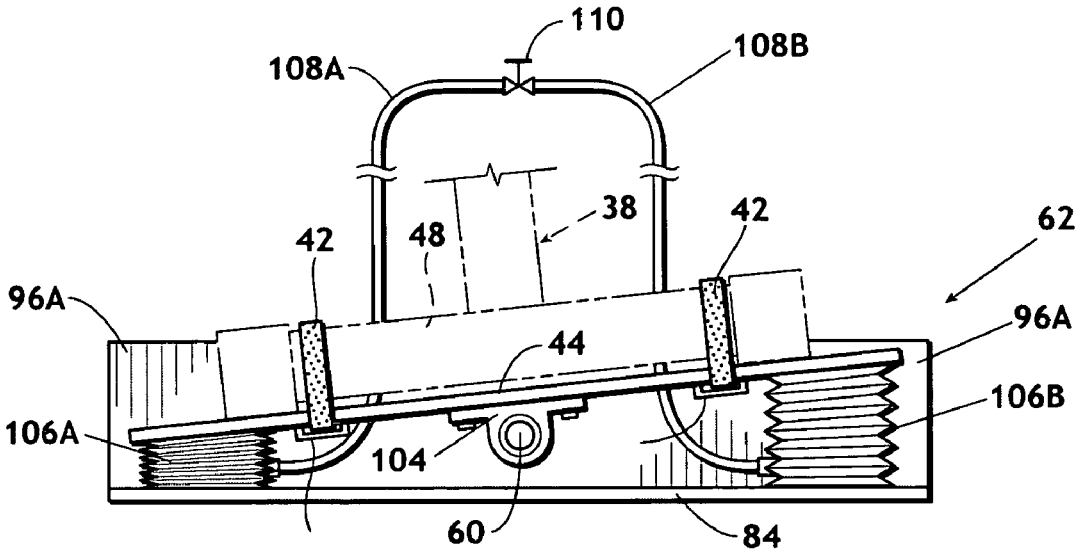

Referring to FIGS. 25 and 26 an additional embodiment of the invention is illustrated in which platform 44, as retained within housing 62, is pivoted about tubular rod 60 that is received within a pillow block 104 that is secured to the bottom of platform 44. Tubular rod 60 is supported at either end such as by attachment to opposing housing sidewalls of which only housing sidewall 96A is shown. In this manner, platform 44 can tilt back and forth about tubular rod 60. A stationary exercise bicycle 38 is mounted on platform 44 as with the other embodiments previously illustrated and described.

Positioned between the underneath bottom surface of platform 44 and the top surface of housing bottom 84 is a first bellows 106A and a second bellows 106B. The interior of bellows 106A and 106B are connected to each other through a first flexible tube 108A and a second flexible tube 108B. Tubes 108A and 108B are joined end-to-end by a manually controllable valve 110. Valve 110 is located convenient to the rider of the bicycle 38 so that the rider may adjust the resistance to fluid flow between bellows 106A and 106B. By tightening valve 110, the fluid flow in the bellows is restricted and therefore resistance to tilting of platform 44 is increased. When valve 110 is open to a greater degree fluid flows more readily between bellows 106A and 106B meaning that platform 44 can more easily tilt from side to side. When valve 110 is turned towards the closed position the resistance to pivotation of platform 44 will serve to accommodate a heavier rider or, for reduce the degree of tilt that a rider experiences as the bicycle sways during vigorous riding activity. By opening the valve and therefore increasing fluid flow between bellows 106A and 106B the rider decreases the resistance which serves to accommodate a smaller rider. If the valve 110 is fully closed then fluid flow between the bellows stops and the pivotation of platform 44 is effectively eliminated. Thus the rider can lock the attitude of bicycle 38 in place when mounting or dismounting by closing valve 110.

While not shown, the bellows system of FIGS. 25 and 26 may additionally employ the use of springs and/or resistance members such as shown in FIGS. 4 through 24 to bias platform 44 to the horizontal position, while bellows 106A and 106B serve to control the resistance encountered in pivoting platform 44 from side to side, that is, the resistance a biker experienced to the swaying action of the bicycle 38 when ridden vigorously.

Bellows 106A and 106B are shown of the pleated type but other types such as a bladder-type may be employed. Further, instead of bellows, cylinders with pistons therein can take the place of the bellows and provide for moving fluid from one to the other to control the resistance to swaying of the bicycle.

Fluid used in bellows 106A and 106B can be either gas or liquid. Due to the compressibility of gas the use of liquid will provide for specific control of pivotation of platform 44. However, the use of gas as a fluid medium has the advantage of providing cushioning action as the bicycle resting on platform 44 is swayed during vigorous exercise.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. A dynamic system for making use of a stationary exercise bicycle having a longitudinal axis that extends from a front portion to a rear portion of the bicycle and front and rear cross members disposed perpendicularly to said longitudinal axis, the system comprising:

a first housing adapted to rest on a support surface and a separate second housing adapted to rest on the support surface;

each housing having a platform and a pair of centrally located bearing pads, each bearing pad having a groove;

each said platform having a generally horizontal upper surface, the platform of said first housing having a pair of straps to removably couple thereon the bicycle front cross member and the platform of said second housing having a pair of straps to removably couple thereon the bicycle rear cross member, each said platform being pivotable end to end about a tubular rod having a longitudinal axis and centrally located on the underside of said platforms in a pair of tubular collars that rest on said grooves of said bearing pads; and at least one deflectable resilient member disposed between each said platform and each said respective housing functioning to normally retain the exercise bicycle uprightly, said generally horizontal upper surfaces of said platforms serving to conveniently receive and support cross members of said stationary exercise bicycle to thereby easily and readily convert said stationary exercise bicycle to one that sways side to side about the longitudinal axis of the tubular rod when vigorously ridden.

2. A dynamic system according to claim 1 wherein each said platform is normally supported substantially parallel to the support surface on which said housings are positioned except when the exercise bicycle is being ridden vigorously.

3. A dynamic base according to claim 1 wherein each said deflectable resilient member is in the form of at least one spring.

4. A dynamic base according to claim 1 wherein each said deflectable resilient member is in the form of at least one compressible member.

5. A dynamic base according to claim 1 wherein each said deflectable resilient member is in the form of a spring having at least a portion thereof coiled about said axial rod.

6. A dynamic base according to claim 1 wherein each said deflectable resilient member is in the form of a combination of at least one spring and in combination with at least one compressible member.

* * * * *